United States Patent [19]

Williams, II

[11] Patent Number: 4,589,716

[45] Date of Patent: May 20, 1986

[54] RELEASABLE SNAP CONNECTOR

[76] Inventor: Joseph R. Williams, II, 5296 Amhurst, Norcross, Ga. 30092

[21] Appl. No.: 532,679

[22] Filed: Sep. 16, 1983

[51] Int. Cl.[4] ..... H01R 13/627

[52] U.S. Cl. ..... 339/91 R; 339/75 M

[58] Field of Search ..... 339/75 R, 75 M, 91 R

[56] References Cited

U.S. PATENT DOCUMENTS

| | | | |
|---|---|---|---|
| 3,075,165 | 1/1963 | Donlevy | 339/91 R |
| 3,374,979 | 3/1968 | Coldren et al. | 248/223 |
| 3,394,337 | 7/1968 | Miller | 339/91 R |
| 3,501,735 | 3/1970 | Ballman et al. | 339/75 M |
| 3,721,939 | 3/1973 | Paugh | 339/91 R |
| 3,908,235 | 9/1975 | Telliard et al. | 24/73 P |
| 3,970,353 | 7/1976 | Kaufman | 339/75 MP |
| 4,460,230 | 7/1984 | McKee et al. | 339/91 R |

FOREIGN PATENT DOCUMENTS

| | | | |
|---|---|---|---|
| 940537 | 12/1948 | France | 339/75 R |
| 1236626 | 6/1960 | France | 339/75 M |

*Primary Examiner*—John McQuade

*Attorney, Agent, or Firm*—Jones & Askew

[57] ABSTRACT

A releasable snap connector configured for use with conventional computer interfacing components, the connector comprising an elongate member for attachment to a conventional interface socket and an adapter member for attachment to a conventional interface plug. The elongate member is releasably retained within the adapter member so as to electrically and mechanically connect the plug and socket.

1 Claim, 8 Drawing Figures

RELEASABLE SNAP CONNECTOR

TECHNICAL FIELD

The present invention relates to releasable snap fasteners, and more particularly relates to a releasable snap connector for electrically and mechanically connecting a signal cable interface plug to an interface socket.

BACKGROUND OF THE INVENTION

A computer system commonly includes a variety of input and output devices known generally as peripherals. Computer peripherals are electrically connected to the central processing unit of a computer system by signal cables. Because most peripherals are not directly compatible with the bus system of a central processing unit, an interface is required to match the peripheral and the central processing unit in terms of data speed, control codes, data format and electrical properties.

To insure uniformity in matching these characteristics, the Electronics Industry Association has adopted to RS232 interface standard. Other common standards include the S100 interface and the IEEE 488 general-purpose interface. Each of these interfaces consist of a plug and socket connector arrangement. Conventionally, an interface plug is operatively attached to the end of a signal cable. The signal cable includes a plurality of wires attached to the interface plug in a well known manner. The interface plug includes a plurality of data leads or "pins" that facilitate the transfer of electronically coded information. The interface plug is secured within a housing, and the pins extend outwardly therefrom. The housing consists of two members configured to be pressed face-to-face and retain the interface plug therebetween. Typically, a plurality of screws secure these housing members one to the other. The conventional interface socket is operatively associated with the bus system of the computer peripheral or the central processing unit to which it is connected. The interface socket may be contained within the cabinet of a component or within a housing as described above. The interface socket is formed with a plurality of receptacles configured for receipt of the interface plug pins so as to further the transfer of electrically coded information. Conventionally, the plug is secured to the socket by two screws which freely extend through openings in the plug and housing to engage two threaded openings in the socket. The screws are manipulated by a screwdriver in the usual and well known manner to assemble the housing and to connect or disconnect the plug and socket.

Several problems exist in the use of screws to assemble a housing and connect an interface plug and socket. One problem is that interface sockets are often positioned one immediately above the other. Given such an arrangement, the threaded openings of the sockets are difficult to access. Because the housings are relatively bulky, they may further block access to the threaded openings. Another problem with both assembling a housing and connecting an interface plug and socket is that the screws are usually small and thus, difficult to manipulate even with a screw driver or like tool. Furthermore, the screws are easily dropped, misplaced or lost.

For all of the above and other reasons, an inordinate amount of time and effort are spent in interfacing computer peripherals. The prior art has heretofore lacked a device that provided a housing that may be quickly assembled and disassembled without screws or like fasteners, and without any additional tools such as a screwdriver. The prior art has heretofore further lacked a connecting device that provided an automatic positive locking action in combination with a quick release mechanism whereby a computer interface plug and socket may be quickly and easily attached and detached without additional fasteners or tools.

SUMMARY OF THE INVENTION

The present invention solves the above-described problems in the prior art by providing a releasable snap connector for electrically and mechanically connecting an interface plug to an interface socket. A releasable snap connector according to the present invention further provides a housing for an interface plug or an interface socket that is readily assembled without use of any screws or any additional tools. A releasable snap connector according to the present invention further provides an automatic positive locking action in combination with a quick release mechanism whereby a computer interface plug and socket are quickly and easily attached and detached without use of any additional fasteners or tools.

Generally described, a releasable snap connector according to the present invention comprises an elongate member suitable for attachment to a threaded opening of a conventional interface socket, a housing for a conventional interface plug, and an adapter member associated with the housing, whereby the adapter member is configured for automatic locking receipt and releasable retention of the elongate member. Furthermore, the housing is readily assembled about a conventional interface plug without screws or any additional tools. Alternately, the elongate member can be secured to the interface plug housing, and the interface socket adapted for receipt and releasable retention of the elongate member according to the present invention.

Described more particularly, the present invention comprises an elongate member with a first end thereof suitable for attachment to a threaded opening of a conventional interface socket, and a second end remote of the first, this second end formed having a ribbed surface. The present invention further comprises a novel housing for a conventional interface plug. The housing includes means for securing a first housing member to a second housing member. The housing is associated with an adapted member. The adapter member includes an internal passageway for receipt of the ribbed second end of the elongate member, a pair of plate members defining an opening and disposed for pivotal movement about the internal passageway, and tab means associated with said plate members, whereby the plate members automatically engage and retain the elongate member within the internal passageway, and depression of the tab means operates said plate members to release said elongate member from said internal passageway. An alternative form of the invention provides for the elongate member to be secured to an existing prior art housing, and the interface socket adapted to provide for releasable retention of the elongate member.

Thus, it is an object of the present invention to provide an improved snap connector.

It is a further object of the present invention to provide a releasable snap connector for a conventional computer interface plug and socket arrangement.

It is a further object of the present invention to provide a releasable snap connector that provides an automatic and positive locking action to electrically and mechanically connect an interface plug to an interface socket.

It is a further object of the present invention to provide a releasable snap connector that provides a quick and easy release mechanism to disconnect an interface plug from an interface socket.

It is a further object of the present invention to provide a releasable snap connector that electrically and mechanically connects and disconnects an interface plug and interface socket without need of an additional tool.

It is a further object of the present invention to provide a releasable snap connector that reduces the time and effort expended in connecting and disconnecting computer peripherals.

It is a further object of the present invention to provide a releasable snap connector that may be retrofitted to a standard interface socket and a standard interface plug.

It is a further object of the present invention to provide a novel housing for a conventional computer interface plug or interface socket.

Other objects, features and advantages of the present invention will become apparent from a reading of the following specification when taken in conjunction with the accompanying drawings.

DETAILED DESCRIPTION

Figure 1:
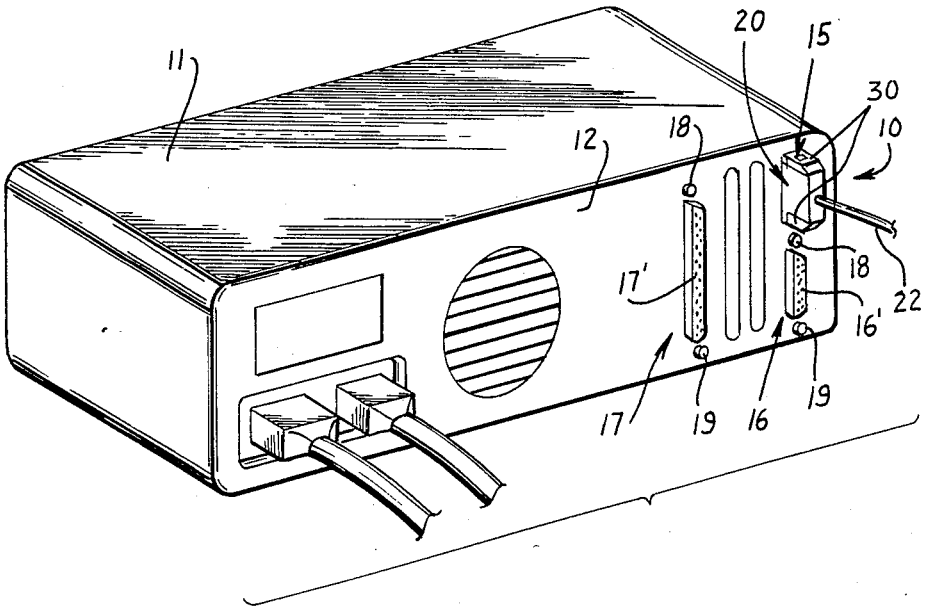
FIG. 1 is a pictorial view of a cabinet of a microcomputer having two embodiments of a releasable snap connector according to the present invention connecting an interface plug to an interface socket.
Figure 4:
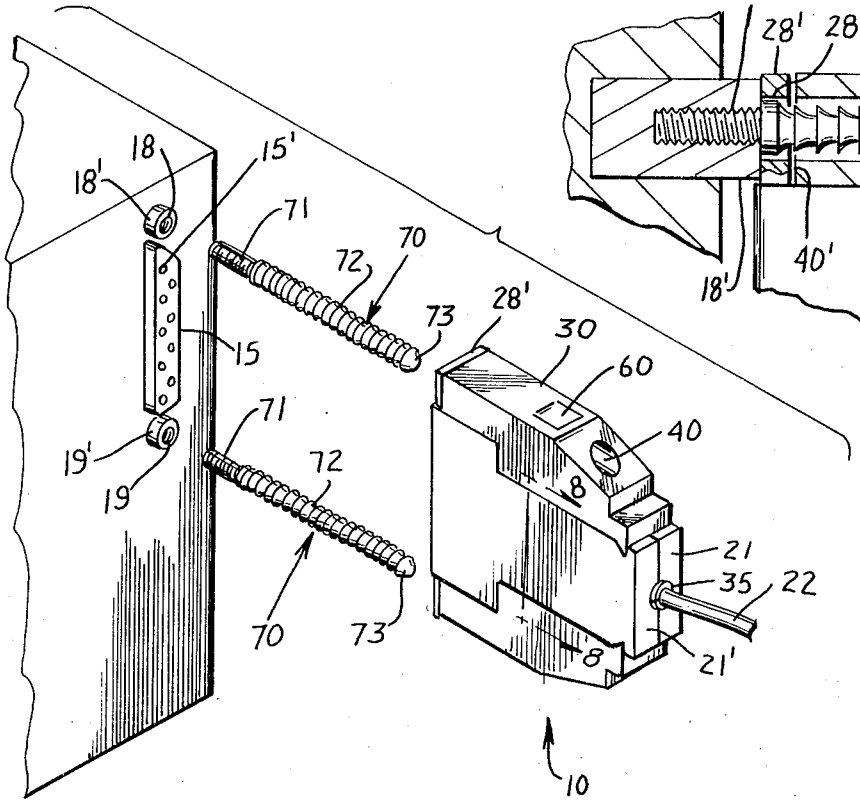
FIG. 4 is an pictorial view of the embodiment in FIG. 1 showing the housing fitted with two adapter members.

Referring now in more detail to the drawings, in which like numerals indicate like parts throughout the several views, FIG. 1 shows a portion of a typical microcomputer system. Such a system typically includes a microprocessing unit which consists of a microprocessor, a main memory, a clock circuit, buffer circuits, driver circuits, various passive circuit elements, and input/output interface devices. A cabinet 11 is provided to house the microprocessing unit. The cabinet 11 includes a rear plate 12 fitted with three conventional interface sockets 15, 16 and 17. The interface sockets 15, 16 and 17 are formed conventionally with a plurality of pin receptacles provided in a raised members 15', 16' and 17', respectively, which extend outwardly from the back panel 12. Interface sockets 15 and 16 are nine (9) pin sockets and, therefore, are formed having nine (9) receptacles in their respective raised members 15' and 16'. Interface socket 17 is a twenty-five (25) pin socket and, therefore, is formed having twenty-five (25) receptacles in its raised member 17'. Each interface socket 15, 16 and 17 further includes two threaded openings 18 and 19. Conventionally located on opposite sides of the raised members 15', 16' and 17', the threaded openings 18 and 19 are provided in lugs 18' and 19' (shown best in FIG. 4) which extend outwardly from the back panel 12 to the level of the raised members. Those skilled in the art will appreciate that the present invention may be adapted for use with a standard nine (9) pin interface, a standard twenty-five (25) pin interface, or any other standard plug and socket arrangement used to interface a computer system. It will be further appreciated that the present invention may be adapted for use with any plug and socket connector wherein it is desired to provide a positive and automatic locking action and a quick-release mechanism.

Figure 7:
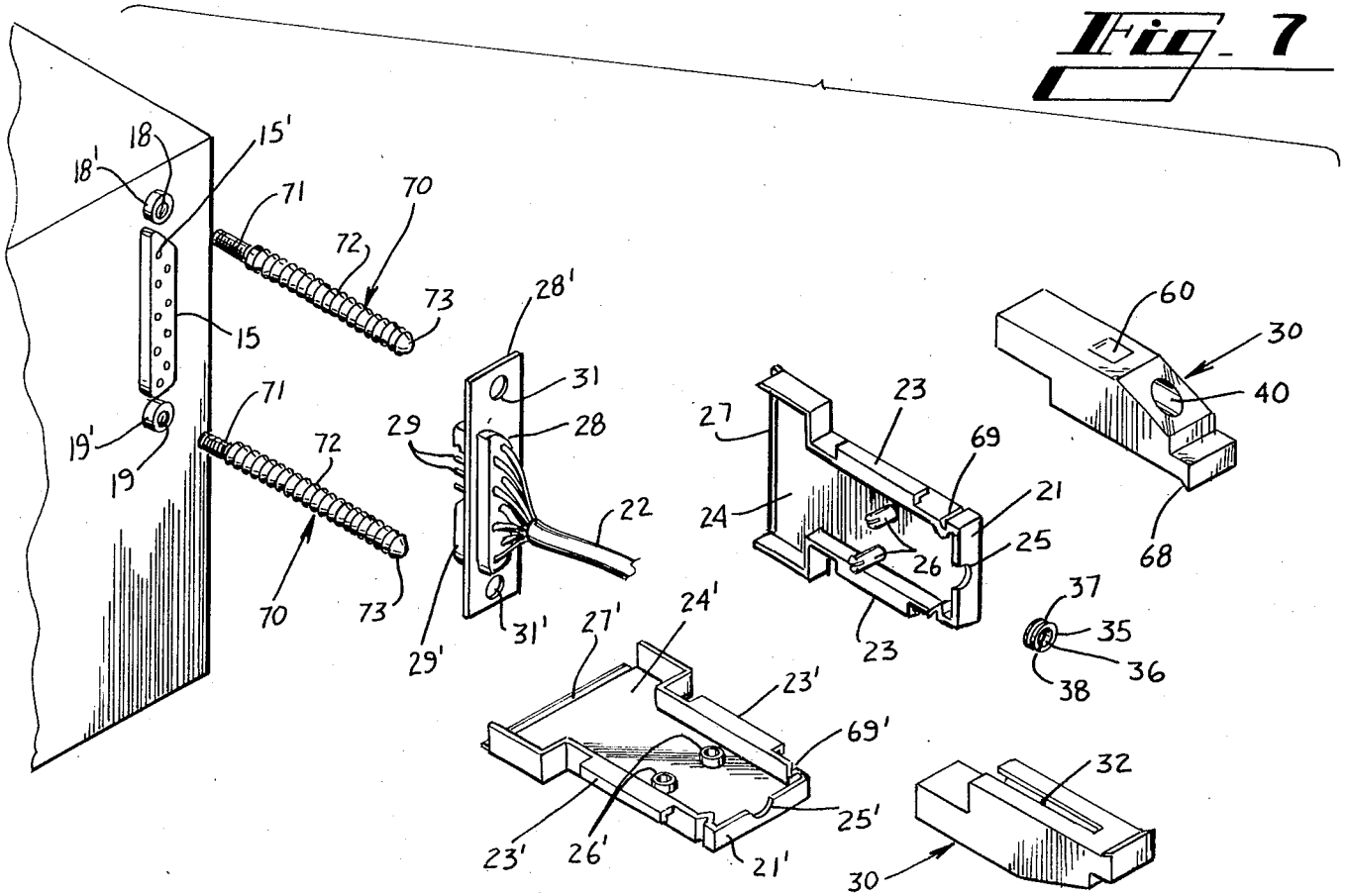
FIG. 7 is an exploded pictorial view of the embodiment of FIG. 1 with a portion cut away to show the pins of the interface plug.

FIG. 1 further shows a releasable snap connector according to the present invention generally at 10. It will be appreciated that the releasable snap connector 10 electronically and mechanically connects a standard interface plug 28 to the interface socket 15. The interface plug 28 is operatively attached to a signal cable 22 in the usual and well known manner (as shown in FIG. 7). The signal cable 22 connects a computer peripheral (not shown) to the microprocessing unit housed in the cabinet 11. Those skilled in the art will appreciate that the present invention may be adapted for use with any standard interface plug and socket regardless of the particular form of the signal cable connected thereto. As will be understood from reading the following specification, the preferred embodiment of a releasable snap connector according to the present invention includes a novel housing 20, an adapter member 30 associated with the housing, and an elongate member 70, each described in detail hereinbelow.

Figure 2:
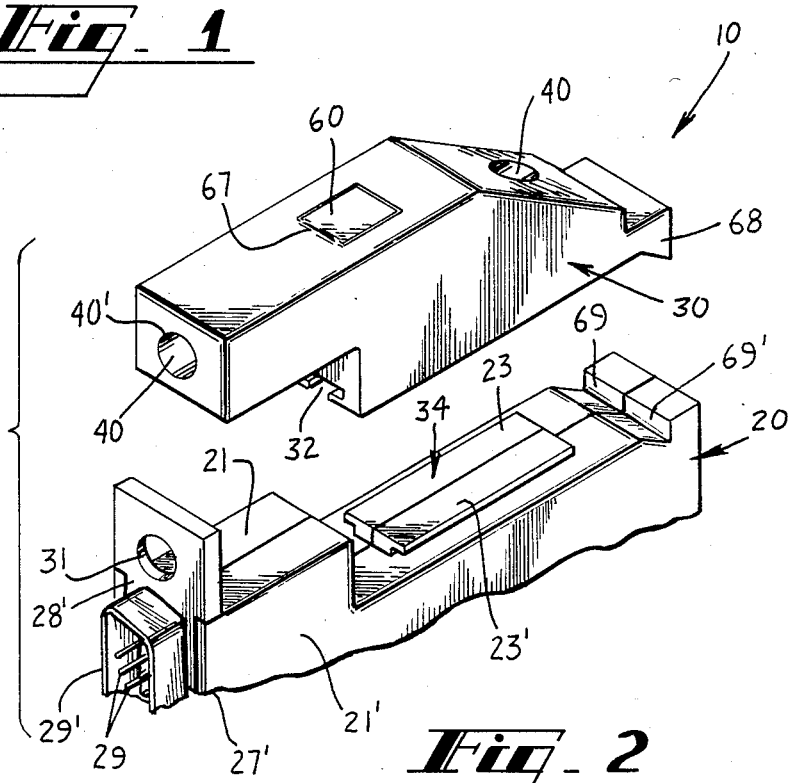
FIG. 2 is an exploded pictorial view of the embodiment shown in FIG. 1, showing an adapter member according to the present invention separated from the housing.

The preferred embodiment of the present invention provides a housing 20 which, as shown in FIG. 7, consists of two half housing members 21 and 21' shaped to be joined together to form the housing 20. The housing members 21 and 21' are generally rectangular in shape with tapered end sections, and may be made of plastic, neoprene, stainless steel, or any other suitable material. Of course, the shape and dimensions of the housing members could be modified in numerous ways. Each housing member 21 and 21' includes two L-shaped extensions 23 and 23', respectively. The extensions 23 and 23' project upwardly and outwardly from mating central portions of the side walls of their respective housing members 21 and 21' such that the four L-shaped extensions combine to form T-shaped members extending from opposite sides of the housing 20, as shown in FIG. 2. The extensions 23 and 23' may be formed integrally with or for attachment to their respective housing members 21 and 21'. Each housing member 21 and 21' further defines a substantially square recessed portion 24 and 24', respectively, that communicates with a substantially cylindrical recessed portion 25 and 25'.

Figure 8:
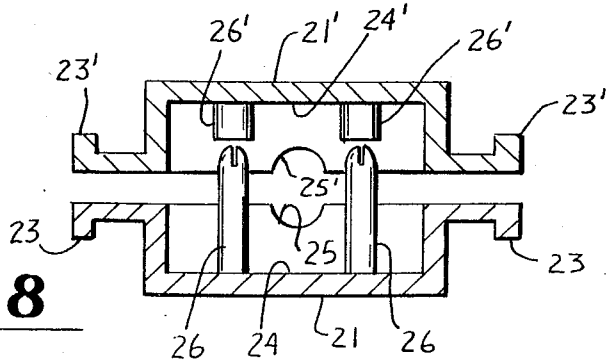
FIG. 8 is a cross-section view of the embodiment in FIG. 1 taken along line 8—8 as shown in FIG. 4.

The housing members 21 and 21' are configured to be secured one to the other so as to form a unitary structure. Housing member 21 includes two pins 26. The pins 26 are cylindrical in shape and may be formed integrally with or for attachment to the inside wall of housing member 21. Thus, the pins 26 extend inwardly into the recessed portion 24. Housing member 21' is formed with two receptacles 26' positioned to engage the pins 26 when the housing members are matingly engaged. The receptacles may be formed integrally with or for attachment to the inside wall of housing member 21'. The receptacles 26 are formed having respective openings of slightly greater diameter than that of the pins 26. Thus, the pins 26 fit snugly within receptacles 26' so as to frictionally secure the housing members 21 and 21'. As shown best in FIG. 8, the pins 26 are tapered at their respective ends to provide easy insertion thereof into receptacles 26'. To further facilitate insertion of the pins 26 into the receptacles 26', each pin may be formed with a slotted opening (FIG. 8) across a diameter of the pin. The housing members 21 and 21' also include a retaining lip 27 and 27', respectively, at their forward ends. As discussed below, the retaining lips 27 and 27' extend over the face plate 28' of an interface plug 28 so as to retain the plug within the housing 20.

FIG. 7 shows a standard interface plug 28 formed integrally with a face plate member 28'. A plurality of pins 29 extend outwardly from the face plate 28' and are protected by a guide plate 29'. The guide plate 29' extends outwardly from the face plate 28' and surrounds the pins 29. The guide plate 29' is generally shaped to matingly receive the raised member 15' and thereby align the pins 29 with the receptacles in the raised member when the plug 28 is engaged to the socket 15. To facilitate attachment of the plug 28 to the socket 15, the face plate 28' is conventionally formed with two openings 31 and 31'. As shown in phantom in FIG. 7, the openings 31 and 31' are positioned on opposite sides of the pins 29 and guard plate 29', so as to align the openings 31 and 31' with the threaded openings 18 and 19.

FIG. 7 further shows a gasket 35 formed with an opening 36. The gasket 35 may be formed of any suitable material such as rubber, and fits about the signal cable 22 so as to insure its retention within the housing members 21 and 21'. To insure this retention, the gasket is formed with a groove 37 in its outer surface. The outside diameter of the gasket 35 is preferably dimensioned so the groove 37 rests and fits snugly within the recesses 25 and 25' in the housing members 21 and 21', respectively, when the housing members are assembled (shown best in FIG. 4). The gasket 35 is split at 38 so as to fit it about the signal cable 22. Because the diameter of the signal cable 22 may vary depending on the number of wires contained therein, the present invention provides gaskets 35 of various sized inside diameters. For example, gasket 35 would be provided with openings 36 of suitable inside diameters to fit snugly about a four wire signal cable 22, a nine wire signal cable 22, a twenty-five wire signal cable 22, and a thirty-seven wire signal cable 22.

Two adapter members are shown generally at 30 in FIG. 1. Although these adapter members 30 are positioned on opposite sides of the housing 20, they are substantially identical in construction. Furthermore, a plug and socket interface could be fitted with only one connector embodying the present invention. Thus, only one adapter member 30 according to the present invention will be described in detail below.

As shown in FIG. 2, a releasable snap connector 10 according to the present invention includes an adapter member 30. The adapter member 30 is formed in a generally L-shaped configuration, and made of any material of suitable rigidity to practice the invention as described below. Suitable materials include, but are not limited to, plastic, brass, stainless steel, and aluminum. The base of the adapter member 30 is formed with a T-shaped channel 32. The channel 32 facilitates attachment of the adapter 30 to the plug housing 20 as described hereinbelow. As further shown in FIG. 2, the L-shaped extensions 23 and 23' form a T-shaped mounting member 34 for receiving the channel 32. Of course, other means of securing the adapter member 30 to the housing surface 27 could be devised. For example, the adapter member 30 could be glued to the housing surface 27, or the adapter member 30 could be formed integrally with the plug housing 20. Those skilled in the art will appreciate that any means of fixedly attaching the adapter member to the plug housing may be utilized for practice of the present invention.

Figure 3:
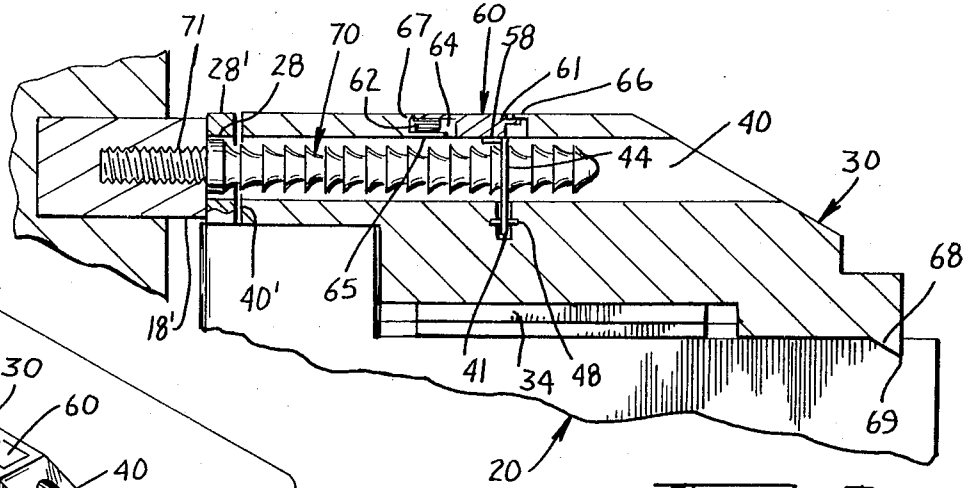
FIG. 3 is a cross-section view of the embodiment in FIG. 1, showing the releasable snap connector of the present invention in its locked position thereby providing a positive locking action to an interface plug and an interface socket.
Figure 6:
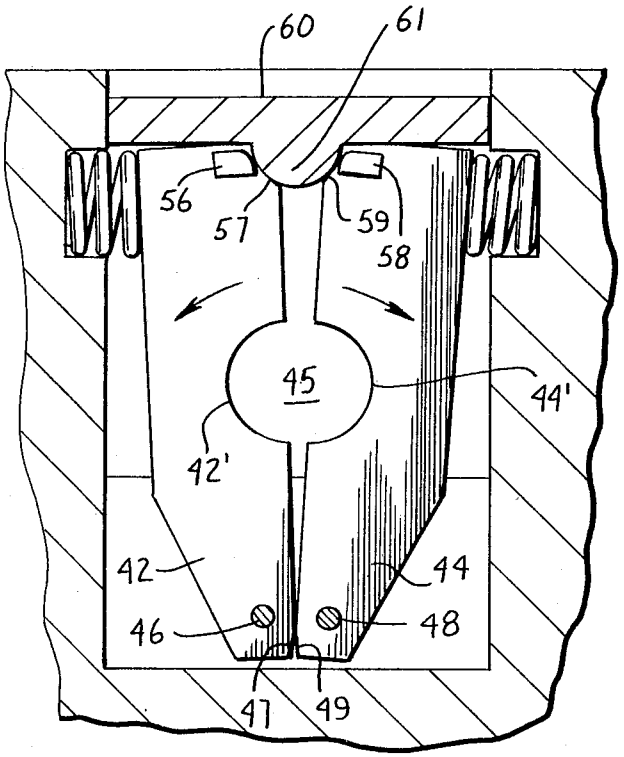
FIG. 6 is a cut-away view similar to that shown in FIG. 5, showing an elongate member according to the present invention free for movement within an adapter member according to the present invention.
Figure 5:
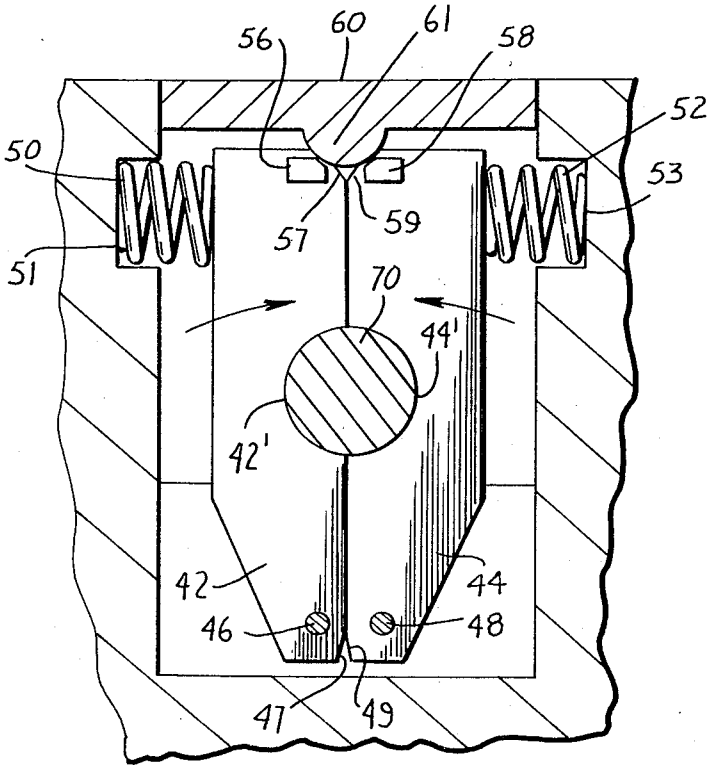
FIG. 5 is a cut-away view of the embodiment shown in FIG. 1, showing an elongate member according to the present invention retained with an adapter member according to the present invention.

The preferred adapter member 30 includes an internal cylindrical passageway 40. As shown in FIGS. 2 and 3, the passageway 40 extends substantially the length of the adapter member 30 and includes an exterior opening 40' which is aligned with the opening 28 in the face plate 25 of the plug housing 20. The adapter member 30 further includes a cavity 41 within which two hinge plates 42 and 44 are mounted. The cavity 41 comprises a narrowing opening surrounding the internal cylindrical passageway 40 and extending perpendicular thereto. The hinge plates 42 and 44 are thin, flattened members of suitable dimension to move freely within the cavity 41. The hinge plates may be formed of any suitably flexible material to provide the break-away capability described below. As shown best in FIG. 6, the hinge plates 42 and 44 are formed having two arcuate indented portions 42' and 44', respectively. The indented portions 42' and 44' define an opening 45 of a slightly reduced diameter relative to the diameter of the internal passageway 40. The hinge plates 42 and 44 are pivotally mounted on two pivot pins 46 and 48, respectively, mounted in the adapter member 30 parallel to the passageway 40. The inner corners of the hinge plates 42 and 44 are beveled at 47 and 49, respectively, to facilitate pivotal movement thereof as described hereinbelow. The hinge plates 42 and 44 are biased inwardly by spring members 50 and 52, respectively. The springs 50 and 52 are fixedly attached at one end within indented recesses 51 and 53, respectively, which are outward extensions of the cavity 41. Thus, the hinge plates 42 and 44 are initially pressed flush one to the other to form the opening 45. The hinge plates 42 and 44 further include two bumper members 56 and 58, respectively, which may be formed integrally with or for attachment to the hinge plates. The bumper members 56 and 58 project from their respective hinge plates 42 and 44 at a point nearest a tab button 60 (described in detail below). The bumper members 56 and 58 are spaced apart one from another across the line of contact between the hinge plates 42 and 44, and formed having curved surfaces 57 and 59, respectively, facing one another.

The adapter member 30 further provides a tab button 60. As shown in FIG. 3, the tab button 60 is formed integrally with the adapter member 30 and has an integrally formed central body with an inwardly protruding portion 61. The tab button 60 is biased outwardly by a spring 62 which sits within a cavity 64. The cavity 64 is defined by the inner wall of the tab button 60 and a shoulder 65 defined in the adapter member 30. As shown further in FIG. 3, the cavity 64 communicates with the passageway 40 and the cavity 41. The tab button 60 substantially fills the mouth of the cavity 64. A shoulder 66 is formed integrally with and protrudes from the upper surface of the adapter member 30. The tab button 60 is preferably cut out of the top surface of the adapter member 30 on three sides, with the fourth scored side 67 comprising a score line that forms a hinge which allows the tab button to be pressed into the cavity 64. Thus, the score 67 provides a pivot line about which the tab button 60 pivots. It is to be further noted that the protruding portion 61 of the tab button 60 is aligned to engage the bumper members 56 and 58. When the tab button 60 is depressed, the inwardly protruding portion 61 engages the bumper members 56 and 58 as described below.

The adapter member 30 is furthermore formed with a protruding V-shaped section 68 at the rearwardmost portion thereof. This section 68 is configured to fit within V-shaped indentations 69 and 69' in the side walls of the housing members 21 and 21', respectively. As described in detail below, the engagement of adapter section 68 with the indentation 69, 69' in the housing 20 serves to maintain engagement of the interface plug 28 to the interface socket 15 by snapping into the indentation 69, 69' during assembly.

The releasable snap connector of the present invention also includes an extension member 70 for mounting on a socket 15, 16 or 17. The preferred extension member 70 is formed of any suitably rigid material, such as stainless steel, brass, aluminum or plastic. The extension member 70 has an externally threaded surface section 71 by which the extension member is removably screwed into the threaded opening 18 or 19 of any socket 15, 16 or 17. The preferred extension member 70 includes an elongate ribbed section 72 immediately adjacent to the attachment end section 71. The ribbed section 72 is formed of a plurality of generally triangular ribs 73. Each rib 73 is formed with its area of greatest cross-sectional diameter nearest the threaded section 71 of the extension member 70. The ribs 73 are defined by a radially extending surface which tapers inwardly until meeting the radially extending surface of the adjacent rib. The ribs 73 are dimensioned to fit freely within the opening in the plate member 25 of the plug housing 24, and the internal passageway 40. However, the maximum diameter of any one rib is larger than the opening 45 defined by the indented portions 42' and 44' of the hinge plates 42 and 44, respectively, when in their closed position. Thus, when the extension member 70 is inserted into the passageway 40, the hinge plates 42 and 44 rest between the ribs as shown in FIG. 3.

A releasable snap connector 10 according to the present invention is used in the following manner. The threaded attachment end 71 of the extension member 70 is secured within the threaded opening 18 of the interface socket 15. The ribbed portion 72 of the extension member 70 extends outwardly from the rear panel 12 of the cabinet 11. The signal cable 22 is connected to the interface plug 28 in the well known manner. The interface plug 28 is placed within the recessed area 24 or 24' of either housing member 21 or 21' in the known manner. Those skilled in the art will appreciate that the housing 20 of the present invention provides for the interface plug 28 to be positioned and retained within the recesses 24, 24', and the signal cable to exit the housing through the opening defined by recesses 25, 25'. The present invention further provides for the housing members 21 and 21' to be assembled about the interface plug 28 without screws, a screwdriver, or the like. The pins 26 of housing member 21 are aligned and inserted into the receptacles 26' of housing member 21'. Those skilled in the art will appreciate that the pins 26 and receptacles 26' are positioned so as not to obstruct the path of the signal cable 22. The housing members 21 and 21' are thereby secured one to the other and the interface plug 28 is retained therein by the retaining lips 27 and 27' of the housing members 21 and 21', respectively. Just prior to full insertion of the pins 26 into the receptacles 26', the split gasket 35 is placed about the signal cable 22 and positioned so as to rest between recesses 25 and 25'. Preferably, the recesses 24 and 24' in the housing members 21 and 21', respectively, fit snugly within the groove 36 in the gasket 35. Of course, the gasket 35 could be friction fitted in such a position in numerous ways.

As described above, the L-shaped extensions 23 and 23' form a T-shaped mounting member 34. The adapter member 30 is thus fitted to the housing 20 by sliding the T-shaped channel 32 over the T-shaped member 34. The L-shaped configuration of the adapter member 30 permits it to be pressed flush against the back side of the face plate 28'. When properly fitted to the housing 20, the protruding section 68 of the adapter member 30 locks within the indentation 69, 69' in the housing 20. The V-shaped configuration of the indentation 69, 69' insures that the adapter member 30 cannot inadvertently be disengaged from the housing 20. The housing 20 is thus secured to the adapter member 30. The locked orientation of the adapter section 68 within the indentations 69, 69' insures this secured relationship. When the adapter member 30 is properly fitted, the opening 31 in the face plate 28' is aligned with the internal passageway 40 in the adapter. To electrically and mechanically connect the interface plug 20 to the interface socket 15, the opening 28 in the face plate 25 is placed at the extending end of the extension member 70 and moved forward. The spring-loaded hinge plates 42 and 44 yield and pass over the tapering surface of the ribs 73 as the extension member 70 enters the passageway 40. The plug 28 is moved forward until the pins 29 engage their mated receptacles in the raised member 15'.

When the extension 70 is fully inserted into the adapter member 30, the inwardly-biased hinge plates 42 and 44 close about the ribbed portion 72 of the extension member 70 and lock against the radial surface of a rib 73. Because the diameter of the opening 45 is slightly less than the greatest diameter of any one ribbed section 73, the adapter member 30 is locked to the extension member 70. Thus, it will be appreciated that the ribbed construction of the present invention is advantageous over a threaded construction because it provides a positive locking action between two plane surfaces.

Even so, the adapter member 30 is easily released by depressing the tab button 60. Depressing the tab button 60 moves the protruding portion 61 thereof into engagement with the bumper members 56 and 58, causing the bumpers to separate. The hinge plates 42 and 44 are thereby pivoted outwardly from the internal passageway 40. When the dimension of the opening 45 is increased sufficiently to exceed the greatest diameter of any of the ribs 73, the adapter member 30 is disengaged from the extension member 70 and the plug 20 may be withdrawn from the socket 15. The tab button 60 automatically returns to its original position when released, as the spring 62 expands. Of course, the tab button 60 may be depressed when engaging the adapter member 30 to the extension member 70, if desired, to prevent any ratchet-like action of the hinge-plates 42 and 44 with the ribbed sections.

The present invention further provides a break-away capability. As described above, the hinge plates 42 and 44 are preferably made of a flexible material. Thus, in the event that the signal cable 22 is inadvertently pulled away from the cabinet 11, the hinge plates 42 and 44 will yield under a sufficient force. This permits the interface plug 28 to be disengaged from the socket 15 so as to prevent the computer component from being pulled off a table, desk, or whatever surface it may be sitting on. Similarly, the elongate member 70 could be made of a flexible material so as to permit the hinge plates to pass its yielding surfaces under sufficient force.

Of course, many variations may be effected within the spirit of the present invention. For example, a locking finger similar to that shown in U.S. Pat. No. 3,374,979 may be included. U.S. Pat. No. 3,374,979 is expressly incorporated herein by reference in its entirety. As shown therein, an insert member is provided with an indented portion which, when fully seated, cooperates with the end of an arm surface to retain the insert member. In reference to the present invention, a locking finger could be provided with an indented portion suited for engagement to a mated surface within the adapter member. Upon complete insertion of the locking finger, the indented portion thereof would cooperate with the mated surface to secure the interface plug and socket. A tab member could be provided to disengage the indented portion of the locking finger from the mated surface of the adapter member.

Thus, it is seen that the present invention enjoys many advantages over the prior art. In particular, the present invention eliminates the need for manipulating small screws to assemble interface housings and to secure interface plugs to interface sockets. Instead, the present invention provides a novel housing that is assembled without screws and screwdrivers, or the problems associated therewith. The housing provides self-contained means of securing the housing members one to the other and further insures that the signal cable cannot be inadvertently disengaged from the interface plug. The present invention provides an automatic locking action for a computer interface plug and socket, and means for quick release of an interface plug from a socket. The present invention further provides for the interface plug and socket to be quickly engaged and disengaged without additional fasteners and tools. Additionally, the present invention prevents a computer component from being pulled off a surface by providing a break-away construction. The present invention therefore drastically reduces the time and effort required to connect and disconnect computer peripherals. It also can be advantageously used to secure plug-and-socket connections not related to computers.

While this invention has been described in detail with particular reference to preferred embodiments thereof, it will be understood that variations and modifications can be effected within the spirit and scope of the invention as described above and as defined in the appended claims.

I claim:

1. A releasable connector comprising:

an elongate member including a threaded end section for attachment to a conventional computer interface socket and a ribbed end section dimensioned to freely extend through a conventional interface plug mounting; and an adapter member, said adapter member comprising means for attaching said adapter member to a conventional interface plug, an internal passageway positioned to communicate with a conventional interface plug mounting and dimensioned to freely receive said ribbed end section of said elongate member, a pair of inwardly-biased plates mounted for radial movement with respect to said internal passageway each of said plates further including a bumper integrally formed therewith, and tab means positioned to engage said bumpers for selectively separating said inwardly biased plates, whereby said elongate member extends through said interface plug mounting sand engages said adapter member so as to releasably retain a conventional computer interface socket.

* * * * *